US009247627B2

(12) United States Patent
Han

(10) Patent No.: US 9,247,627 B2
(45) Date of Patent: Jan. 26, 2016

(54) LIGHT STRING

(71) Applicant: Houhua Han, Suizhou (CN)

(72) Inventor: Houhua Han, Suizhou (CN)

( * ) Notice: Subject to any disclaimer, the term of this patent is extended or adjusted under 35 U.S.C. 154(b) by 0 days.

(21) Appl. No.: 14/747,584

(22) Filed: Jun. 23, 2015

(65) Prior Publication Data

US 2015/0289351 A1 Oct. 8, 2015

Related U.S. Application Data

(63) Continuation of application No. 13/915,668, filed on Jun. 12, 2013.

(30) Foreign Application Priority Data

Apr. 8, 2013 (CN) ..... 2013 2 0169368 U
Apr. 18, 2013 (CN) ..... 2013 2 0197290 U

(51) Int. Cl.
*H05B 39/00* (2006.01)

(52) U.S. Cl.
CPC ..... *H05B 39/00* (2013.01)

(58) Field of Classification Search
CPC .. H05B 39/00; H05B 33/0803; H05B 41/232; F21S 4/001
USPC ..... 315/185 R, 185 S, 187, 188, 192; 362/227, 234, 253, 254
See application file for complete search history.

(56) References Cited

U.S. PATENT DOCUMENTS 7,029,145 B2 * 4/2006 Frederick ..... F21S 4/001 315/185 S
8,324,820 B2 * 12/2012 Janning ..... H05B 33/0821 315/185 R
8,836,224 B2 * 9/2014 Chen ..... H05B 33/0815 315/185 R
8,917,027 B2 * 12/2014 Radermacher ..... H05B 33/0821 315/200 R
9,035,559 B2 * 5/2015 Han ..... H05B 39/00 315/168
2012/0086349 A1 * 4/2012 Segan ..... H05B 33/0842 315/187
2013/0214247 A1 * 8/2013 Hu ..... H01L 33/04 257/13
2014/0300286 A1 * 10/2014 Han ..... H05B 37/00 315/187

* cited by examiner

*Primary Examiner* — Haissa Philogene

(57) ABSTRACT

A light string includes a plurality of bulbs connected in series and powered by an AC power supply. Each bulb is connected in parallel with a capacitor, the capacitor is a polarized electrolytic capacitor, and capacitance of the capacitor is 47 uF-120 uF; a rated voltage of the capacitor is higher than a rated voltage of the bulb, and the rated voltage of the capacitor is 16V-100V; and when one bulb in the light string fails, the capacitor that is connected in parallel with the failed bulb operates normally; a positive plate and a negative plate of the capacitor connected in parallel with said each bulb are both covered with an oxide film insulating layer; when the light string is powered on, the oxide film insulating layer prevents breakdown and short circuit of the capacitor connected in parallel with said each bulb under the influence of a reverse voltage of the AC power.

5 Claims, 1 Drawing Sheet

LIGHT STRING

CROSS-REFERENCE TO RELATED APPLICATIONS

The present application is a continuation-in-part of U.S. application Ser. No. 13/915,668, filed on Jun. 12, 2013, which claims priority of China Patent Application No. 201320169368.1, filed on Apr. 8, 2013 and China Patent Application No. 201320197290.4, filed on Apr. 18, 2013, each of which are incorporated herein by reference.

BACKGROUND OF THE INVENTION

1. Field of the Invention

The invention relates to electric light strings.

2. Description of Related Art

Light strings are widely used for decorative purposes, especially for holiday lighting. Light strings refer to incandescent filament lamps or LED lamps connected electrically in a series. Generally, a light string includes more than 10 incandescent filament lamps, and is powered by mains electricity, such as 110V AC mains electricity. Thus, a voltage supplied on each incandescent filament lamp is 1.5V to 12V. When the light string is powered on, a surge current may be generated and may burn out the incandescent filament lamp bulb mounted in a lamp base. In the conventional light strings, when the filament of the incandescent filament lamp bulb fails and the bulb remains in the string, or when the bulb is removed from its socket for replacement, the closed path for the flow of electrical current is interrupted and the remainder of the lamps in the string will no longer be illuminated.

U.S. Pat. No. 8,324,820 for capacitor shunted LED light string discloses a capacitor shunt across terminals of each LED light. When one LED light fails, the capacitor with which the failed LED light is connected to in parallel is broken down and shorts out, thus continues current in the light string, and keeps the light string illuminated. However, the capacitor shunt has several disadvantages.

Firstly, when one LED light fails, the corresponding capacitor shorts out, and a voltage drop on the failed part (composed of the failed LED light and the shorted-out capacitor) become lower than before, thus a voltage drop cross the other LED light rises accordingly. When more and more LED lights fails, the voltage drop cross each normal LED light rises significantly. As we know, when voltage drop across an LED is twice than the rated voltage of an LED, the LED will burn up in an hour because of over-heat. Thus, when more and more LED lights fails, the remained LED lights may all burned up.

Secondly, the low break-down voltage chip capacitor is not suitable for high-power incandescent filament lamps, because the line current is much larger than that in a LED light, and the broken-down capacitor will be over-heat rapidly, and will be destroyed and invalid.

Thirdly, the manufacturing cost of the break-down capacitor is high and too pricey to be practical.

BRIEF SUMMARY OF THE INVENTION

An object of the present invention is to provide an improved light string, when one bulb in the light string fails, the capacitor that is connected in parallel with the failed bulb operates normally.

A light string includes a plurality of bulbs connected in series and powered by an AC power supply. Each bulb is connected in parallel with a capacitor, the capacitor is a polarized electrolytic capacitor, and capacitance of the capacitor is 47 uF-120 uF; a rated voltage of the capacitor is higher than a rated voltage of the bulb, and the rated voltage of the capacitor is 16V-100V; and when one bulb in the light string fails, the capacitor that is connected in parallel with the failed bulb operates normally; a positive plate and a negative plate of the capacitor are both covered with an oxide film insulating layer; when the light string is powered on, the oxide film insulating layer prevents breakdown and short circuit of the capacitor connected in parallel with said each bulb under the influence of a reverse voltage of the AC power.

Preferably, the positive plate and the negative plate of the capacitor are also both wound with insulating substances, and the insulating substances withstand the reverse voltage of the AC power.

Preferably, each capacitor in the light string is connected in parallel at two ends of the bulb according to the same polarity direction.

Preferably, each capacitor in a front half part of the light string is connected in parallel at two ends of the bulb according to one polarity direction, and each capacitor in a rear half part of the light string is connected in parallel at two ends of the bulb according to another polarity direction; the number of the bulbs in the front half part of the light string is equal to the number of the bulbs in the rear half part of the light string, and the another polarity direction is opposite to the same polarity direction.

Preferably, the positive plate and the negative plate of the capacitor are irregularly arranged, the positive plate and the negative plate are connected in parallel with each bulb, and the positive plate and the negative plate have a double insulating layer.

Adopting the polarized electrolytic capacitor in the above-mentioned light string, the above-mentioned capacitor needs to have the capability to withstand the reverse voltage in the AC current, thus a positive plate and a negative plate of the capacitor connected in parallel with each bulb are both covered with a thickened oxide film insulating layer; and the thickened oxide film insulating layer can prevent occurrence of breakdown and short circuit for the capacitor connected in parallel with each bulb under the action of the reverse voltage of the AC current when the light string is powered on due to the fact that the oxide film insulating layer can withstand the reverse voltage of the AC current. Further, insulating substances are wound on both of the positive plate and the negative plate of the capacitor connected in parallel with each bulb in the above-mentioned light string to enable the above-mentioned capacitor to possess the capability of withstanding voltage twice, and the insulating substances can make the reverse voltage withstood by the capacitor not lower than the rated voltage of the bulb.

BRIEF DESCRIPTION OF THE SEVERAL VIEWS OF THE DRAWING(S)

The foregoing and other exemplary purposes, aspects and advantages of the present invention will be better understood in principle form the following detailed description of one or more exemplary embodiments of the invention with reference to the drawing(s), in which.

DETAILED DESCRIPTION OF THE INVENTION

The invention will now be described in detail through several embodiments with reference to the accompanying drawing.

Figure 1:
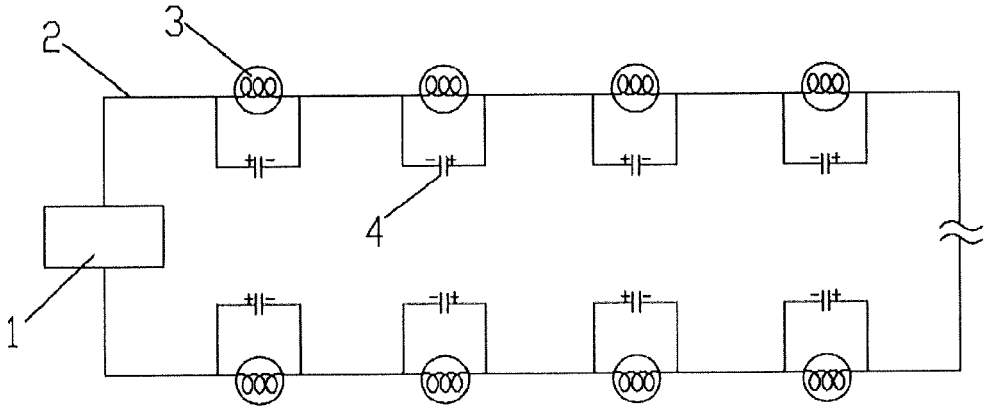
FIG. 1 is a circuit diagram of a light string in accordance with a first embodiment of the present invention.

Referring to FIG. 1, a light string according to the first embodiment of the present invention mainly includes a plurality of incandescent filament lamps 3 which are electrically connected in series by wires 2. The plurality of incandescent filament lamps 3 may be electrically connected to an AC power supply via a power plug 1. The AC power supply is preferably AC mains electricity. The incandescent filament lamps 3 are tungsten filament lamps. As a rated voltage of the incandescent filament lamps 3 is low, generally 1.5 volts to 12 volts, the light string usually includes more than 10 incandescent filament lamps when connecting to 110V mains electricity.

In the embodiment, each incandescent filament lamp 3 is electrically connected in parallel to a capacitor 4. The capacitors are polarized electrolytic capacitors, and can be connected in the light string terminal forwardly or reversely. A capacitance of each capacitor is 47 microfarads~120 microfarads (μF), and preferably 70~120 μF. A rated voltage of each capacitor is 16 volts~100 volts, and is at least twice as much as that of each incandescent filament lamp. When a rated voltage of an incandescent filament lamp 3 is 2.5V and a rated current is 0.17 A, a 100 μF, 16V capacitor is preferably adopted. When a rated voltage of an incandescent filament lamp is 12V and a rated current is 0.08 A, a 100 μF, 25V capacitor is preferably adopted. In this way, when the light string is powered on, the capacitors 4 are charged and absorb the surge current in the wires 2. Thus, the voltage dropped on each incandescent filament lamp 3 rises slowly and the incandescent filament lamps 3 are safe. The capacitor 4 also performs power compensation and electrical connection by repeatedly charging and discharging.

When the filament of the incandescent filament lamp fails and the bulb remains in the light string, or when the bulb is removed from its socket for replacement, because the rated voltage of the capacitor with which the failed or removed lamps is connected to in parallel is much larger than that of the incandescent filament lamp and the capacitance of the capacitor is large, the capacitor can operate normally (not been breakdown and destroyed), and is charged and discharged repeatedly to realize electrical connection, thus, the closed path for flow of AC electrical current is still closed and allows the remaining incandescent filament lamps to continue to glow.

Furthermore, because an effective impedance of the capacitor is larger than that of an incandescent filament lamp, a voltage drop across the failed part become slightly larger than before, and each voltage drop across the normal light is lowered down slightly, thus the other incandescent filament lamps will not be burned down caused by over-voltage.

It is understandably, in other embodiments, only a part of the incandescent filament lamps 3 in the light string is connected in parallel to a capacitor 4. Polarized electrolytic capacitors have the advantages of manufacture and low cost. As the capacitors can be connected in the light string terminal regardless of their polarity, they can be connected in the circuit forwardly or reversely, convenient assembly.

Generally, each incandescent filament lamp 2 includes a bulb and a socket for holding the bulb. The socket is configured electrical connectors (generally two sheets) for electrically connecting the pins of the bulb. The capacitor 4 may electrically connect to the electrical connectors to realize the parallel connection to the bulb. Sometimes, a bulb is known as an incandescent filament lamp.

Figure 2:
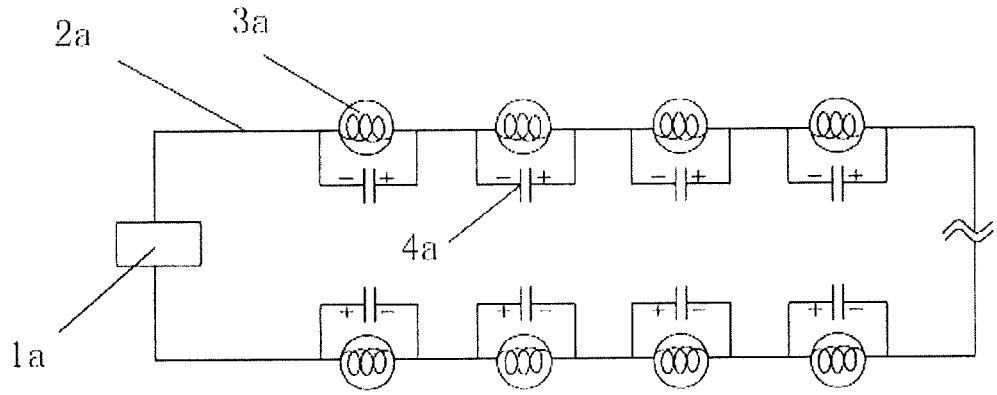
FIG. 2 is a circuit diagram of a light string in accordance with a second embodiment of the present invention.
Figure 3:
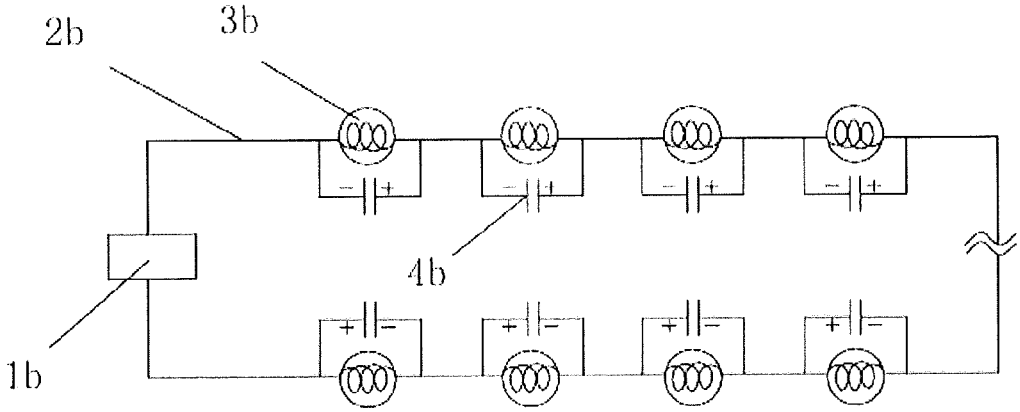
FIG. 3 is a circuit diagram of a light string in accordance with a third embodiment of the present invention.

Referring to FIGS. 2 and 3, a bulb is known as an incandescent filament lamp in the second and third embodiments of the present invention, and the second or third embodiment provides a light string, comprising a plurality of bulbs which are connected in series and powered by an AC power supply, wherein each bulb is connected in parallel with a capacitor, the capacitor is a polarized electrolytic capacitor, and the capacitance of the capacitor is 47 uF-120 uF; a rated voltage of the capacitor is higher than a rated voltage of the bulb, and the rated voltage of the capacitor is 16V-100V; and when one bulb in the light string fails, the capacitor that is connected in parallel with the failed bulb operates normally.

The conventional polarized electrolytic capacitor cannot be applied in the circuit which is powered by the AC current supply due to the fact that the above-mentioned capacitor is a polarized electrolytic capacitor which can only bear a forward voltage but cannot withstand a reverse voltage in the AC current, otherwise the conventional polarized electrolytic capacitor will be broken down by the reverse voltage in the AC current and thus a short circuit can be caused.

For these reasons, to adopt the polarized electrolytic capacitor in the above-mentioned light string, the above-mentioned capacitor needs to have the capability to withstand the reverse voltage in the AC current, thus a positive plate and a negative plate of the capacitor connected in parallel with each bulb are both covered with a thickened oxide film insulating layer; and the thickened oxide film insulating layer can prevent occurrence of breakdown and short circuit for the capacitor connected in parallel with each bulb under the action of the reverse voltage of the AC current when the light string is powered on due to the fact that the oxide film insulating layer can withstand the reverse voltage of the AC current.

The voltage that the thickened oxide film insulating layer can withstand is higher than the reverse voltage in the circuit so that the capacitor can withstand the reverse voltage. Further, the positive plate and the negative plate of the capacitor are also covered with an insulating layer so that the capacitor may be further resistant to the higher reverse voltage.

Further, insulating substances are wound on both of the positive plate and the negative plate of the capacitor connected in parallel with each bulb in the above-mentioned light string to enable the above-mentioned capacitor to possess the capability of withstanding voltage twice, and the insulating substances can make the reverse voltage withstood by the capacitor not lower than the rated voltage of the bulb.

A polarity direction of the capacitor connected in parallel with the bulb in the light string can be achieved in two ways as follows with the above-mentioned capacitor having reverse voltage-withstanding capability:

(1) each capacitor in the light string is connected in parallel at both ends of the bulb according to the same polarity direction. As shown in FIG. 2, an AC power supply 1*a* supplies powder to a plurality of bulbs 3*a* connected in series via a power line 2*a*, and each capacitor 4*a* is connected in parallel at both ends of the bulbs 3*a* according to the same polarity direction;

(2) each capacitor in the front half part of the light string is connected in parallel at both ends of the bulb according to the same polarity direction, and each capacitor in the rear half part of the light string is connected in parallel at both ends of the bulb according to another polarity direction; the number of the bulbs in the front half part of the light string is equal to the number of the bulbs in the rear half part of the light string, and the above-mentioned another polarity direction is opposite to the above-mentioned same polarity direction. As shown in FIG. 3, the AC power supply 1*b* supplies power to a plurality of bulbs 3*b* connected in series via a power line 2*b*, each capacitor 4*b* in the front half part (i.e. the upper half part of the light string shown in FIG. 3) of the light string is connected in parallel at both ends of the bulbs 3*b* according to the same polarity direction, while each capacitor in the last half section (i.e. the lower half part of the light string shown in FIG. 3) of the light string is connected in parallel at both ends of the bulbs 3*b* according to the polarity direction which is opposite to the polarity direction of each capacitor 4*b* in the front half part of the light string.

In sum, in embodiments of the present invention, each bulb in the light string is connected in parallel with one capacitor which is a polarized electrolytic capacitor having the capability of withstanding the reverse voltage of the AC current, thus when the light string in FIGS. 1, 2 and 3 is powered on, breakdown and short circuit of the capacitor cannot be caused under the action of the reverse voltage of the AC current, and the whole light string operates normally.

Understandably, the positive plate and the negative plate of the capacitor are irregularly arranged, the positive plate and the negative plate are connected in parallel with each bulb, and the positive plate and the negative plate have a double insulating layer.

While the invention has been described in terms of several exemplary embodiments, those skilled on the art will recognize that the invention can be practiced with modification within the spirit and scope of the appended claims. In addition, it is noted that, the Applicant's intent is to encompass equivalents of all claim elements, even if amended later during prosecution.

I claim:

1. A light string, comprising a plurality of bulbs connected in series and powered by an AC power supply, wherein each bulb is connected in parallel with a capacitor, the capacitor is a polarized electrolytic capacitor, and capacitance of the capacitor is 47 uF-120 uF; a rated voltage of the capacitor is higher than a rated voltage of the bulb, and the rated voltage of the capacitor is 16V-100V; and when one bulb in the light string fails, the capacitor that is connected in parallel with the failed bulb operates normally;

a positive plate and a negative plate of the capacitor both have an oxide film insulating layer thereon; when the light string is powered on, the oxide film insulating layer prevents breakdown and short circuit of the capacitor connected in parallel with said each bulb under the influence of a reverse voltage of the AC power.

2. The light string according to claim 1, wherein the positive plate and the negative plate of the capacitor are also both wound with insulating substances, and the insulating substances withstand the reverse voltage of the AC power.

3. The light string according to claim 1, wherein each capacitor in the light string is connected in parallel at two ends of the bulb according to the same polarity direction.

4. The light string according to claim 1, wherein each capacitor in a front half part of the light string is connected in parallel at two ends of the bulb according to one polarity direction, and each capacitor in a rear half part of the light string is connected in parallel at two ends of the bulb according to another polarity direction; the number of the bulbs in the front half part of the light string is equal to the number of the bulbs in the rear half part of the light string, and the another polarity direction is opposite to the same polarity direction.

5. The light string according to claim 1, wherein the positive plate and the negative plate of the capacitor are irregularly arranged, the positive plate and the negative plate are connected in parallel with each bulb, and the positive plate and the negative plate have a double insulating layer.

* * * * *